United States Patent [19]

Adams

[11] Patent Number: 4,527,369

[45] Date of Patent: Jul. 9, 1985

[54] DOOR FRAME CLIP

[75] Inventor: George C. Adams, Ann Arbor, Mich.

[73] Assignee: Rollform, Inc., Ann Arbor, Mich.

[21] Appl. No.: 431,822

[22] Filed: Sep. 30, 1982

[51] Int. Cl.[3] ..... E06B 1/04

[52] U.S. Cl. ..... 52/211; 52/214; 52/717

[58] Field of Search ..... 52/214, 211, 213, 717, 52/212, 466, 718

[56] References Cited

U.S. PATENT DOCUMENTS

| | | | |
|---|---|---|---|
| 1,150,790 | 8/1915 | Swanson | 52/718 X |
| 2,216,047 | 9/1940 | Place | 52/718 |
| 2,217,574 | 10/1940 | Tinnerman | 52/718 |
| 2,243,322 | 5/1941 | Van Uum | 52/718 X |
| 2,786,249 | 3/1957 | Poupitch | 52/718 X |
| 3,107,759 | 10/1963 | Day et al. | 52/212 |
| 3,276,180 | 10/1966 | Westinghouse | 52/718 X |
| 3,401,487 | 9/1968 | Brandt et al. | 52/212 X |
| 3,742,668 | 7/1973 | Oliver | 52/718 X |
| 4,094,112 | 6/1978 | Smith et al. | 52/211 |
| 4,193,238 | 3/1980 | Chalmers et al. | 52/718 X |

*Primary Examiner*—Carl D. Friedman

*Attorney, Agent, or Firm*—Gifford, VanOphem, Sheridan, Sprinkle & Nabozny

[57] ABSTRACT

A fastener is disclosed for attaching a channel shaped fastening strip to a door frame or the like. The fastener comprises a pair of oppositely facing loops which are insertable into the channel of the facing strip and, in doing so, the loops frictionally engage the sides of the facing strip and secures the facing strip to the frame. At least one and preferably two tangs formed on the end of the fastener extend through it and engage the sides of an opening in the frame to detachably secure the fastener to the frame.

7 Claims, 4 Drawing Figures

DOOR FRAME CLIP

BACKGROUND OF THE INVENTION

I. Field of the Invention

The present invention relates generally to fasteners and, more particularly, to a fastener for attaching a facing strip to a door frame or the like.

II. Description of the Prior Art

In modern office buildings and the like, the wall partitions are of a modular construction. Typically, metal framing members or studs extend between the floor and ceiling of the building and wall panels are thereafter secured to these framing members to form the wall partition.

The wall openings and door frames for such office buildings are also constructued of metal and secured directly to the metal wall studs by screws or the like.

In order to provide a more pleasing appearance for the joint between the door frame and the wall, it has been the previously known practice to secure a facing strip to the door frame so that the facing strip extends across and covers the joint or intersection between the door frame and the wall. Each facing strip is generally channel shaped thus having an elongated base wall and a side wall extending substantially perpendicularly outwardly from each edge of the base wall. With the facing strip secured across the door frame and wall intersection, the base wall of the facing strip is generally parallel to the plane of the wall partition while the side walls of the facing strip are generally perpendicular to the plane of the wall partition.

The facing strip is usually attached to the door frame by a concealable fastener. One type of previously known concealable fastener consisted of a short metal band having a loop formed at each end. These loops and the band are constructed so that the facing strip could be snapped over the loops whereupon the loops would frictionally engage the side walls of the facing strip.

These previously known fasteners, however, are usually fixedly secured to the door frame and cannot be removed from the door frame without deforming either the fastener or the door frame itself. For example, in one type of previously known door frame, locking tabs are first punched out from the door frame. With the fastener positioned in between the locking tabs, the locking tabs are bent against the fastener thus sandwiching the fastener in between the locking tabs and the door frame. This method for attaching the fastener to the door frame, while effective in operation, is expensive in manufacturing costs. Furthermore, in the event that the fastener becomes damaged, it is very difficult, it not altogether impossible, to replace the fastener in the door frame at the installation site.

SUMMARY OF THE PRESENT INVENTION

The present invention provides a fastener for attaching a facing strip to a door frame or the like which overcomes all of the above mentioned disadvantages of the previously known fasteners.

In brief, the fastener according to the present invention is constructed from a single band of resilient material, such as spring steel. The band is formed into two oppositely facing loops which are connected together by a central portion of the band. In addition, these loops are spaced apart from each other by a distance substantially the same as the spacing between the side walls of the facing strip so that, when the loops are positioned within the facing strip channel, the loops frictionally engage the facing strip and secure the fastener and facing strip together.

The fastener is positioned against side of a thin walled panel of the door frame. An attachment portion of the fastener extends outwardly from one of the loops and flatly abuts against the other side of the door frame panel so that the door frame panel is sandwiched in between the central portion and attachment portion of the fastener. A tang formed at the free end of the fastener attachment portion is inserted through and engages a hole in the door frame panel thus securing the fastener to the door frame. In the preferred form of the invention, a second tang is formed at the other end of the fastener which also engages the opening in the door frame to firmly, but detachably, secure the fastener and the door frame together.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
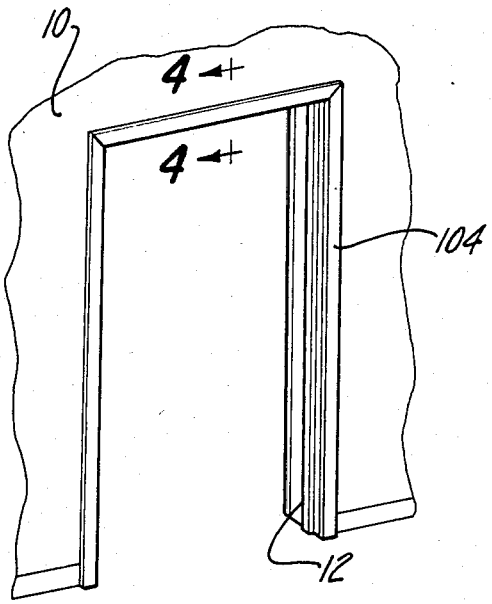
FIG. 1 is a fragmentary perspective view illustrating a facing strip secured to a door frame with a preferred embodiment of the fastener of the present invention.
Figure 2:
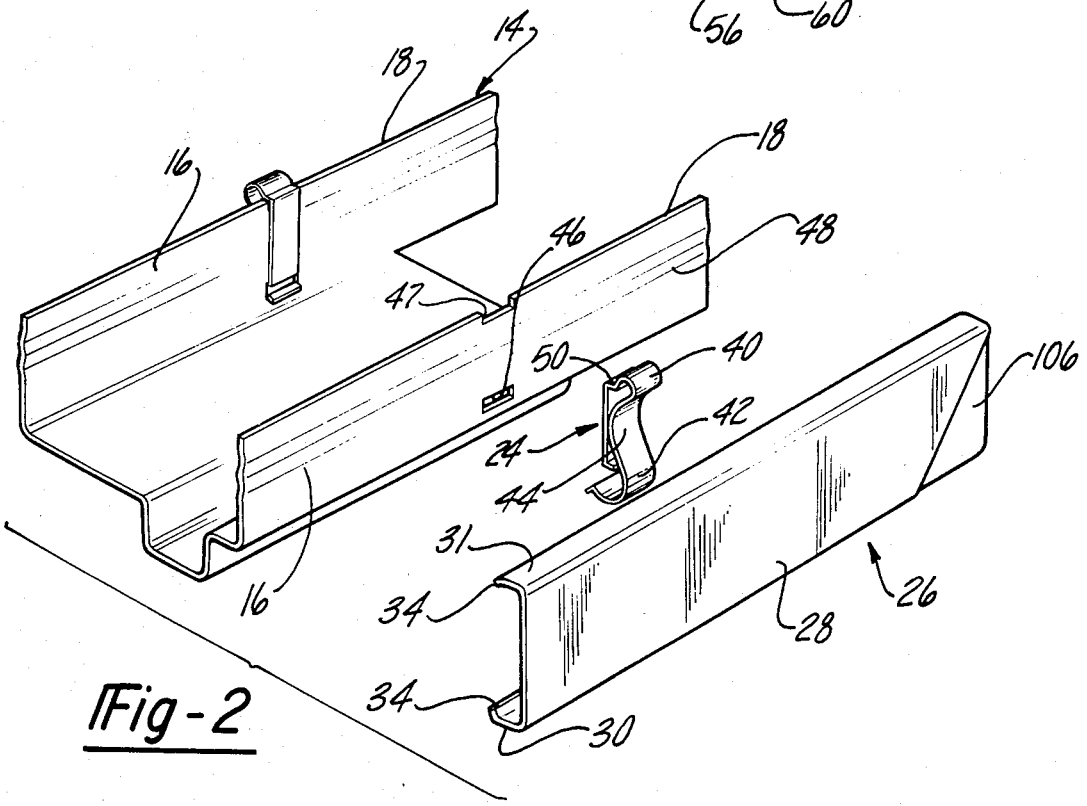
FIG. 2 is a fragmentary exploded view of the preferred embodiment of the fastener of the present invention.

With reference first to FIGS. 1 and 2, a wall partition 10 having a door opening or door frame 12 is thereshown of the type used in office buildings and the like. As such, both the sides and top of the door frame 12 are constructed from metal channel members 14 as is best shown in FIG. 2. Each member 14 of the door frame 12 includes a thin walled side panel 16 which is coplanar with the wall 10 when the door frame 12 is installed in the wall partition 12. Each side panel 16 overlies a portion of the wall and has a free edge 18 which forms an intersection or joint with the wall 10.

Figure 4:
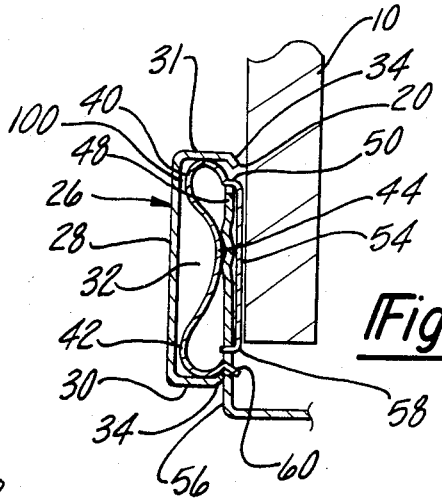
FIG. 4 is a sectional view taken substantially along line 4—4 in FIG. 1 and enlarged for clarity.

With reference now particularly to FIGS. 2 and 4, a preferred embodiment of the fastener 24 of the present invention is thereshown for securing a facing strip 26 to the door frame 12 so that the facing strip 26 covers the intersection 20 between the edges 18 of the door frame 12 and the wall 10. The facing strip 26 is conventional in construction and comprises an elongated and narrow base wall 28 having a pair of side walls 30 and 31 extending perpendicularly outwardly from each edge. The base wall 28 together with the side walls 30 and 31 thus form a channel 32. The free edges 34 of each side wall 30 and 31 are bent slightly toward each other for a reason to be subsequently described.

The fastener 24 is preferably constructed from a single piece band of resilient material, such as spring steel. The band is formed into two oppositely facing loops 40 and 42 which are spaced apart from each other by a distance substantially equal to the width of the facing strip channel 32. A central portion 44 of the band joins the loops 40 and 42 together.

Still referring to FIGS. 2 and 4, the side panel 16 of the door frame 12 includes a rectangular opening 46 which is aligned with a notch 47 formed in the panel edge 18. The fastener 24 is positioned against the door frame panel 16 so that its central portion 44 abuts against one side 48 of the door frame panel 16. Simultaneously, a portion 50 of the fastener 24 is positioned within the notch 47 which prevents the fastener 24 from longitudinally shifting along the door frame.

One end of the band extends outwardly from the fastener loop 40 and forms an attachment portion 52 of the fastener. The attachment portion 52 flatly abuts against the other or rear side 56 of the door frame panel 16. In doing so, the door frame panel 16 is sandwiched in between the attachment portion 54 and central portion 44 of the fastener 24. A tang 58 at the free end of the fastener attachment portion 54 extends through the opening 46 in the door frame to firmly, but detachably, secure the fastener 24 to the door frame 12. Preferably, a second tang 60 extends outwardly from the other fastener loop 42 and through the door frame opening 46 to firmly secure the lower loop 42 to the door frame against both lateral and outward movement.

Figure 3:
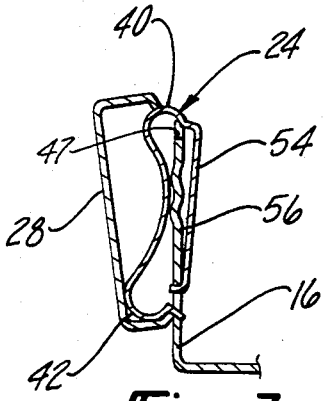
FIG. 3 is a view illustrating the attachment of a facing strip to a door frame utilizing a preferred embodiment of the fastener of the present invention.

With reference now to FIGS. 3 and 4, with the fastener 24 secured to the door frame 14 in the previously described fashion, the lower end of the facing strip 26 is positioned around the lower loop 42 and the facing strip 26 is pressed against the door frame 14 (FIG. 3). In doing so, the facing strip 26 deflects the upper loop 40 and attachment 54 away from the rear side 56 of the door frame panel 16 as shown in FIG. 3. Further pressure against the facing strip 26 causes the fastener loops 40 and 42 to enter into the channel 32 of the facing strip 26 and frictionally engage the facing strip side walls 30. The resiliency of the fastener 24 will return the fastener 24 along the facing strip 26 to the position shown in FIG. 4 whereupon the facing strip 26 covers the door frame and wall intersection 20 in the desired fashion. In addition, the inwardly facing ends 34 of the facing strip 26 wrap around the rear sides of the loops 40 and 42 as best shown in FIG. 4, to firmly secure the strip 26 and fastener 24 together.

As best shown in FIG. 4, the facing strip side walls 30 and 31 are asymmetrical in shape with the upper side wall 31 being somewhat wider than the lower side wall 30, In addition, the facing strip channel 32 is wider than the upper fastener loop 40 thus forming a small space 100 between the upper loop 40 and the channel base wall 28. This space 100 enables the facing strip to be adjusted so that its top free edge 34 flatly abuts against the wall 10 as well as accommodate the laydown of the vertical casing facing strips 104 (FIG. 1) on the offset overlay 106 (FIG. 2) of the header facing strip.

From the foregoing, it can be seen that the fastener of the present invention is advantageous in several different respects. First, the fastener 24 can be easily manually secured to or removed from the door frame at the installation site as required. A further advantage of the fastener of the present invention is that the fastener is firmly secured to the door frame without the necessity or additional hardware, such as screws, rivets or the like. The fastener of the present invention is preferably attached to the door frame at the factory.

Having described my invention, however, many modifications thereto will become apparent to those skilled in the art to which it pertains without deviation from the spirit of the invention as defined by the scope of the appended claims.

I claim:

1. A fastener for attaching a facing strip to a door frame or the like, said facing strip comprising an elongated base wall and a side wall extending substantially perpendicularly outwardly from each longitudinal edge of the base wall, said base wall and side walls together forming a channel, said fastener comprising:

a pair of oppositely facing loops, said loops spaced from each other by a distance substantially the same as the distance between said facing strip side walls so that, upon insertion of said fastener into said channel, said loops frictionally engage the facing strip side walls, and means integrally formed with said fastener for detachably securing said fastener to the frame without deformation of said frame, wherein said frame includes a thin walled panel having an opening, said fastener comprising a central portion extending between said loops and abutting against one side of said thin walled panel and wherein said securing means comprises an attachment portion of said fastener extending through said opening, and wherein said fastener comprises an attachment portion attached at one end to and extending outwardly from one loop, said attachment portion flatly abutting against the other side of said thin walled panel, and wherein said attachment portion comprises a tang formed on its other end, said thin walled panel being sandwiched in between said central and said attachment portions.

2. The invention as defined in claim 1 and comprising a second tang secured to and extending outwardly from the other loop, said second tang extending through and frictionally engaging one side of said opening.

3. The invention as defined in claim 2 wherein said fastener comprises a one-piece band of resilient material.

4. The invention as defined in claim 3 wherein said resilient material comprises spring steel.

5. The invention as defined in claim 4 wherein said thin walled panel includes an edge and wherein at least a portion of said one loop is positioned over said edge whereby said one loop is deflectible over said edge.

6. A building construction for forming an opening in a wall partition comprising:

a door frame, a fastener, said fastener having means for engaging a facing strip of the type having an elongated base wall and a side wall extending substantially perpendicularly outwardly from each longitudinal edge of the base wall, said base wall and side walls together forming a channel, and means integrally formed with said fastener for detachably securing said fastener to said door frame, wherein said fastener comprises a pair of oppositely facing loops, said loops spaced from each other by a distance substantially the same as the distance between said facing strip side walls so that, upon insertion of said fastener into said channel, said loops frictionally engage the facing strip side walls, and means integrally formed with said fastener for detachably securing said fastener to the frame, wherein said frame includes a thin walled panel having an opening, said fastener comprising a central portion extending between said loops and abutting against one side of said thin walled panel and wherein said securing means comprises an attachment portion of said fastener extending through said opening, wherein said frame includes a notch, said notch being longitudinally aligned with said opening, and wherein a portion of said fastener is positioned in said notch to prevent lateral movement between said fastener and said frame.

7. The invention as defined in claim 6 wherein said fastener comprises an attachment portion attached at one end to and extending outwardly from one loop, said attachment portion flatly abutting against the other side of said thin walled panel, and wherein said attachment portion comprises a tang formed on its other end, said thin walled panel being sandwiched in between said central and said attachment portions.

* * * * *

UNITED STATES PATENT AND TRADEMARK OFFICE

CERTIFICATE OF CORRECTION

PATENT NO. : 4,527,369

DATED : July 9, 1985

INVENTOR(S) : George C. Adams

It is certified that error appears in the above-identified patent and that said Letters Patent is hereby corrected as shown below:

Column 1, line 52 delete "it" (2nd occurrence) insert --if--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*